US007997048B2

(12) United States Patent
Bernhard

(10) Patent No.: US 7,997,048 B2
(45) Date of Patent: Aug. 16, 2011

(54) CONTAINER FILLING PLANT, SUCH AS A BEVERAGE BOTTLING PLANT, FOR FILLING CONTAINERS WITH A LIQUID BEVERAGE AND FOR CLOSING FILLED CONTAINERS

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 957 days.

(21) Appl. No.: 11/245,990

(22) Filed: Oct. 7, 2005

(65) Prior Publication Data

US 2006/0086410 A1 Apr. 27, 2006

(30) Foreign Application Priority Data

Oct. 9, 2004 (DE) ..... 10 2004 049 330
Oct. 15, 2004 (DE) ..... 10 2004 050 397

(51) Int. Cl.
*B67B 6/00* (2009.01)
*B67B 1/06* (2006.01)

(52) U.S. Cl. ..... 53/253

(58) Field of Classification Search ..... 53/253, 53/331.5, 317, 319
See application file for complete search history.

(56) References Cited

U.S. PATENT DOCUMENTS 2,076,631 A 4/1937 Gantzer
2,382,696 A 8/1945 De Milleville
2,699,718 A 1/1955 Wright
4,363,649 A 12/1982 Yamato et al.
5,713,403 A * 2/1998 Clusserath et al. ..... 141/101

FOREIGN PATENT DOCUMENTS

| | | | |
|---|---|---|---|
| FR | 1 418 965 | A | 11/1965 |
| GB | 684 057 | A | 12/1952 |
| JP | 1199896 | A | 8/1989 |
| JP | 62639189 | | 9/1994 |
| JP | 6321295 | A | 11/1994 |
| JP | 8324689 | A | 12/1996 |
| JP | 2002104587 | | 4/2002 |

OTHER PUBLICATIONS

U.S. Appl. No. 11/245,948, filed Oct. 7, 2005, Herbert Bernhard.
GB 15253 A A.D. 1911, Jun. 20, 1912, Adolph Schneider.
Chinese Office Action 200510113502.6 and English translation thereof.

* cited by examiner

*Primary Examiner* — Rinaldi I. Rada
*Assistant Examiner* — John Paradiso
(74) *Attorney, Agent, or Firm* — Nils H. Ljungman & Associates

(57) ABSTRACT

Container filling plant, such as a beverage bottling plant, for filling containers with a liquid beverage and for closing filled containers. The abstract of the disclosure is submitted herewith as required by 37 C.F.R. §1.72(*b*). As stated in 37 C.F.R. §1.72(*b*): "A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims." Therefore, any statements made relating to the abstract are not intended to limit the claims in any manner and should not be interpreted as limiting the claims in any manner.

20 Claims, 8 Drawing Sheets

CONTAINER FILLING PLANT, SUCH AS A BEVERAGE BOTTLING PLANT, FOR FILLING CONTAINERS WITH A LIQUID BEVERAGE AND FOR CLOSING FILLED CONTAINERS

BACKGROUND

1. Technical Field

This application relates to a bottling or container filling plant for filling containers, such as bottles, with a liquid beverage, and for closing filled containers. This application also relates to a beverage bottling plant for filling bottles with a liquid beverage filling material having a receiving table or unscrambling table or setup table or prep table for the container handling machines therein.

This application further relates to a device and/or a closing or capping machine employing a rotary construction for the capping of containers such as, for example, bottles or similar containers with screw tops or crown corks with a rotating carousel on which a plurality of container capping positions, each equipped with a capping element, are formed. Advantageous developments and other embodiments are described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Container handling machines are regularly used for the production of beverages in the beverage industry. These machines include, among other things, rinsers, fillers, cappers and labeling machines.

These handling machines can be linear machines, but they can also be rotary machines. Because both types of machines are amply described in prior art documents, there is no need to provide a more detailed description at this point. The accompanying figures show only rotary machines, although this is in no way intended to limit the scope of the present application to rotary machines.

The containers to be handled, e.g. bottles, cans or beverage cartons, to and from these container handling machines are generally fed to and removed from these container handling machines by means of single-track conveyors, whereby the containers are transferred between the conveyor and the handling machine or between the handling machine and the conveyor by means of inlet or outlet star wheels of the prior art.

It has been found to be altogether advantageous to combine the inlet and outlet star wheels and the elements for the mechanical connection of these star wheels with at least one of the container handling machines that is present into what is called a receiving table or an unscrambling table or a setup table or a prep table. Thereby additional elements, such as feed worms, housings or control elements of the container handling machines, can also be components of this receiving table.

Because such receiving tables, with all their attendant advantages, represent a significant cost factor on account of the complexity of their design and construction, and the constructions that are disclosed in the prior art had numerous individual surfaces, edges, corners and undercuts that offered starting points for undesirable contamination, multiple attempts have been made in the past to simplify and improve receiving tables with regard to their manufacture, costs and hygiene or cleaning.

Thus, for example, the unexamined German Patent Application DE 195 12 849 presents a variant of a receiving table in which the receiving table comprises essentially a flat, relatively thick metal plate which is oriented three-dimensionally at a specified angle with respect to the horizontal. This reference also teaches that spraying devices are provided on the higher edge of the metal plate and collecting gutters on the lower edge.

For the cleaning and/or disinfection of a device of this type, cleaning fluid is sprayed onto the metal plate by the sprayer devices. As a result of the inclined orientation of the metal plate there is a directed flow of the cleaning agent, by which any dirt or contamination that may adhere to the metal plate is supposed to be rinsed off.

One of several disadvantages of a device of this type is that the metal plates used require a large amount of material, and the mechanical processing of this material is complicated, time-consuming and expensive on account of the numerous borings that have to be introduced into these plates at specified angles.

DE 200 02 483 U1 describes another receiving table. This patent describes a receiving table that has an essentially rectangular base body, whereby this base body is provided with a superstructure in the shape of a hip roof made of sheet metal.

This hip-roof-shaped superstructure is in turn interrupted in the vertical plane by the mountings or receptacles for inlet or outlet star wheels, cappers etc.

Of course a receiving table of the type described in DE 200 02 483 U1 uses significantly less material compared to other realizations, although the fabrication of the hip-roof superstructure frequently poses technical difficulties.

DE 298 05 957 describes another configuration which attempts to reduce the number of components and areas present on receiving tables to the bare essentials. For example, receiving tables as described in DE 298 05 957 first comprise a base body which is assembled from elements in the shape of truncated cones, whereby these elements are connected by straight connecting pieces, the upper side of which has a gable-roof shape.

Such receiving tables also comprise conical and/or columnar elements which extend vertically upward starting from the base body and support devices on their upper end, such as transport star wheels, cappers, feed worms etc.

As a result of the configuration of a receiving table of this type, the manufacturing and cleaning during operation are simplified, and the associated costs are reduced accordingly. However, improvements can still be made in the amount of material required for the base body.

Capping machines, in particular those that employ a rotary construction, for the capping of containers such as bottles, for example, with screw caps or using crown corks are basically known from the prior art (U.S. Pat. No. 2,076,631). The caps that are used for screw-on closures can be made of metal (e.g. aluminum), for example, although they can preferably also be made of plastic. These plastic caps are prefabricated with an internal screw thread, by means of which, during the capping process, they are screwed onto the external screw thread that is provided on the mouth of the bottle and are screwed tight with a specified torque.

In one model that has been particularly popular in the past, a plurality of screwing units are provided in a rotor that is driven in rotation, the shaft of which is rotated in the conventional model by a pinion that sits on the shaft and runs along a gear rim that is fixed on the stator. The shaft, for its part, rotates the screw head to which the cap has previously been fed, conventionally engaged in a clamp. During the rotation of the rotor, the screwing units are moved downward one after the other by means of their height control system, which can consist, for example, of a non-rotating lifting cam, onto the bottle underneath, and the cap is thereby screwed onto the bottle.

There are also capping machines that close the containers with crown corks. To simplify the matter somewhat, crown cork and screw-cap closure machines differ essentially in that the screwing units are replaced by deformation units that deform the crown corks during the capping process so that the corks seal the containers airtight. In most cases, crown corking machines also have a central height adjustment that makes it possible to adjust the machine to different container heights.

One thing that most all capping machines have in common is that, essentially, the containers to be capped are delivered to a container inlet and the capped containers are removed at a counter outlet. The containers are delivered and removed by conveyor belts, and in some cases also by transfer star wheels.

Another thing that most all capping machines have in common is that they are located in geographic proximity to the filling machines, which are naturally upstream in terms of the process. In practice, preference is generally given to two variants. Initially, capping machines were frequently located on the setup table that is frequently associated with a filling machine. Alternatively, capping machines may be constructed in the form of free-standing machines, which may be connected, such as by using conveyor belts, to the upstream filling machine and the downstream components of the plant.

The realization of the drive system on capping machines of the prior art is also comparatively complicated and expensive. It is conventional, for example, to transmit the required drive power by means of a mechanical coupling with the corresponding filling machine directly from the filling machine to the capping machine. The components required for this transmission are complicated and expensive to manufacture and assemble.

Capping machines of the prior art located on setup tables or separate frames are also complicated, time-consuming and expensive to clean.

In addition, these types of capping machines are not suitable for use in the novel design of a setup table as described herein below.

OBJECT OR OBJECTS

The object of at least one embodiment is to essentially eliminate the disadvantages of the receiving tables for container handling machines as discussed above, such as, for example, the large amount of material that is required, and the related high manufacturing costs and large surface areas with disadvantageous configurations that tend to collect dirt and contaminants. The present application teaches that the receiving tables of the prior art can be replaced by a simple frame or brace construction with optimized or reduced surfaces.

The object of at least one other embodiment is to realize a capping machine which has a particularly simple and thus economical construction, and in which the cleaning of the machine is further improved, with a simultaneous reduction of costs. Another object is to design a capping machine that is suitable for use with the novel setup table disclosed herein. This application therefore teaches a capping machine that is connected mechanically and/or for the transmission of force only by a non-rotating central pillar with the space surrounding the capping machine. Additional advantageous developments are discussed herein below.

SUMMARY

Possible embodiments of the invention are explained in greater detail below with reference to at least one exemplary embodiment which is illustrated in the accompanying drawings.

The advantages and disadvantages of some types of setup tables are described above. The present application teaches that conventional setup or descrambling tables can be replaced by rod-shaped elements to eliminate said disadvantages.

This novel and altogether advantageous configuration of the setup or descrambling tables requires fundamental modifications to the capping machines located on said setup tables. This modified construction results from the fact that rotating and non-rotating components are arranged in a stacked structure. The rotating components include the container carriers, the capping or screw heads with the associated carrier element, and the elevation or lowering elements for the caps or screw-on caps or containers. The non-rotating components include the drive motor, the drive train and the curved track(s) for the elevation and lowering elements.

To essentially prevent the non-rotating components, such as the curved track, for example, from rotating along with the rotating parts, the torques and/or forces that would cause the rotation of said non-rotating components should be neutralized or absorbed as much as possible, if not completely neutralized or absorbed. The neutralization or absorption of the rotational forces requires that capping machines with at least two elements, e.g. the main pillar and torque supports or the main pillar and drive train, be connected with the base frame or the setup table fastening of the capping machine.

In addition, the capping or closing machine as disclosed herein promotes ease of cleaning and minimizes build-up of residues from the bottling process on the machine and support frame. During the bottling process, it is not uncommon for an amount of a liquid in the bottles, after filling, to splash out of the bottles during transport from the filling machine to the capping machine. Further, it is not uncommon for an amount of an effervescent liquid to bubble over and out of the top of the bottles during transport from the filling machine to the capping machine. Consequently, amounts of liquid are often spilled onto the capping machine and support frame during the bottling process, causing the surfaces of the machine and the support frame to become dirty, which could increase the chance for build-up of bacteria that could contaminate the liquid. The design of the capping machine and support frame disclosed herein minimizes the surface area of the machine and frame exposed to spillage, and also increases access to these surfaces by personnel for ease of cleaning of the machine. In addition, the risk of contamination is also thereby decreased.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Developments, advantages and potential applications of the invention are described below with reference to exemplary embodiments and the accompanying drawing. All the features described and/or illustrated, in themselves or in any possible combination, are the object of the invention, regardless of their placement in the claims or the references between claims. The content of the claims is also incorporated by reference into this description.

Figure 1:
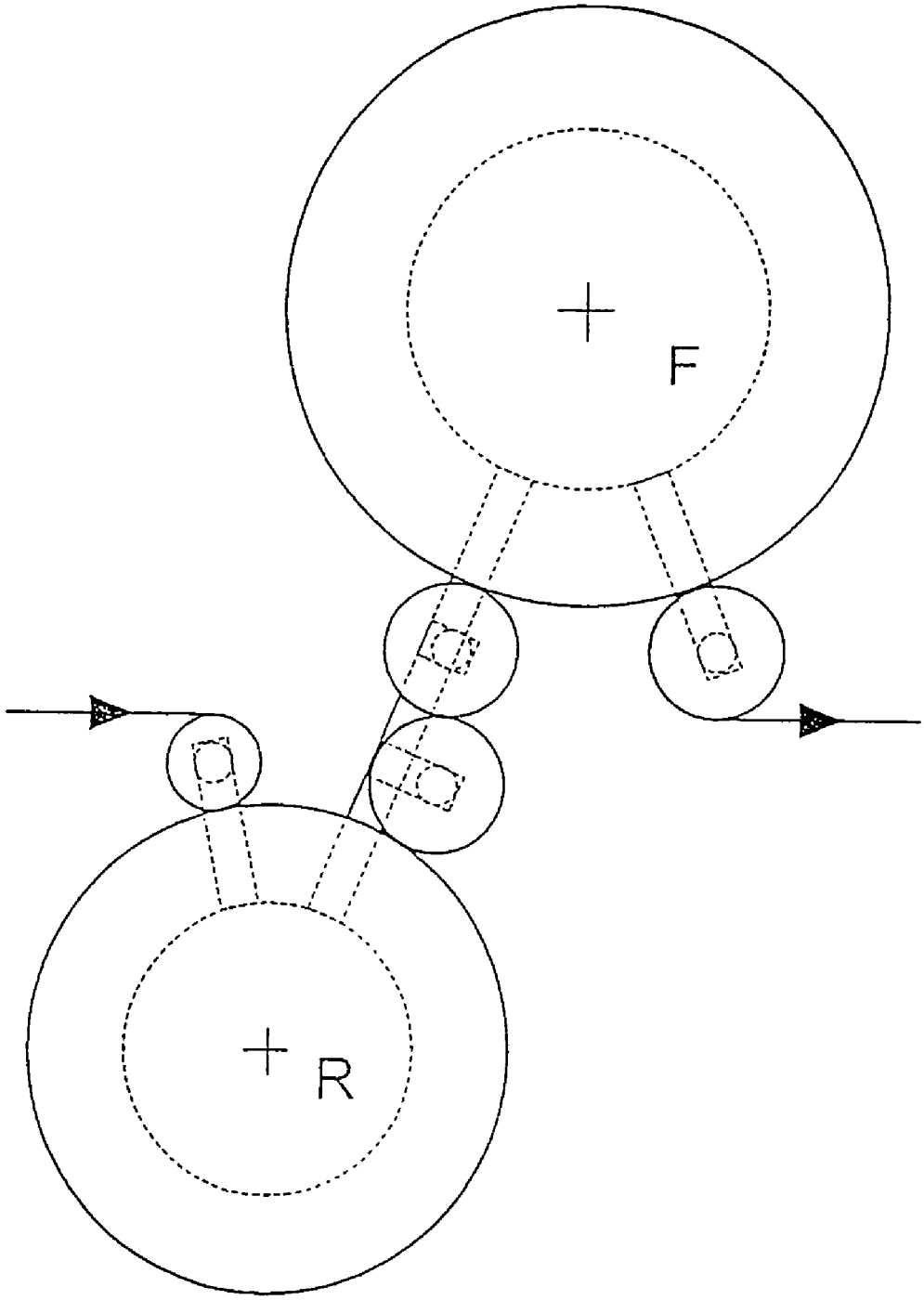
FIG. 1 is a simplified overhead view of a setup table.
Figure 1A:
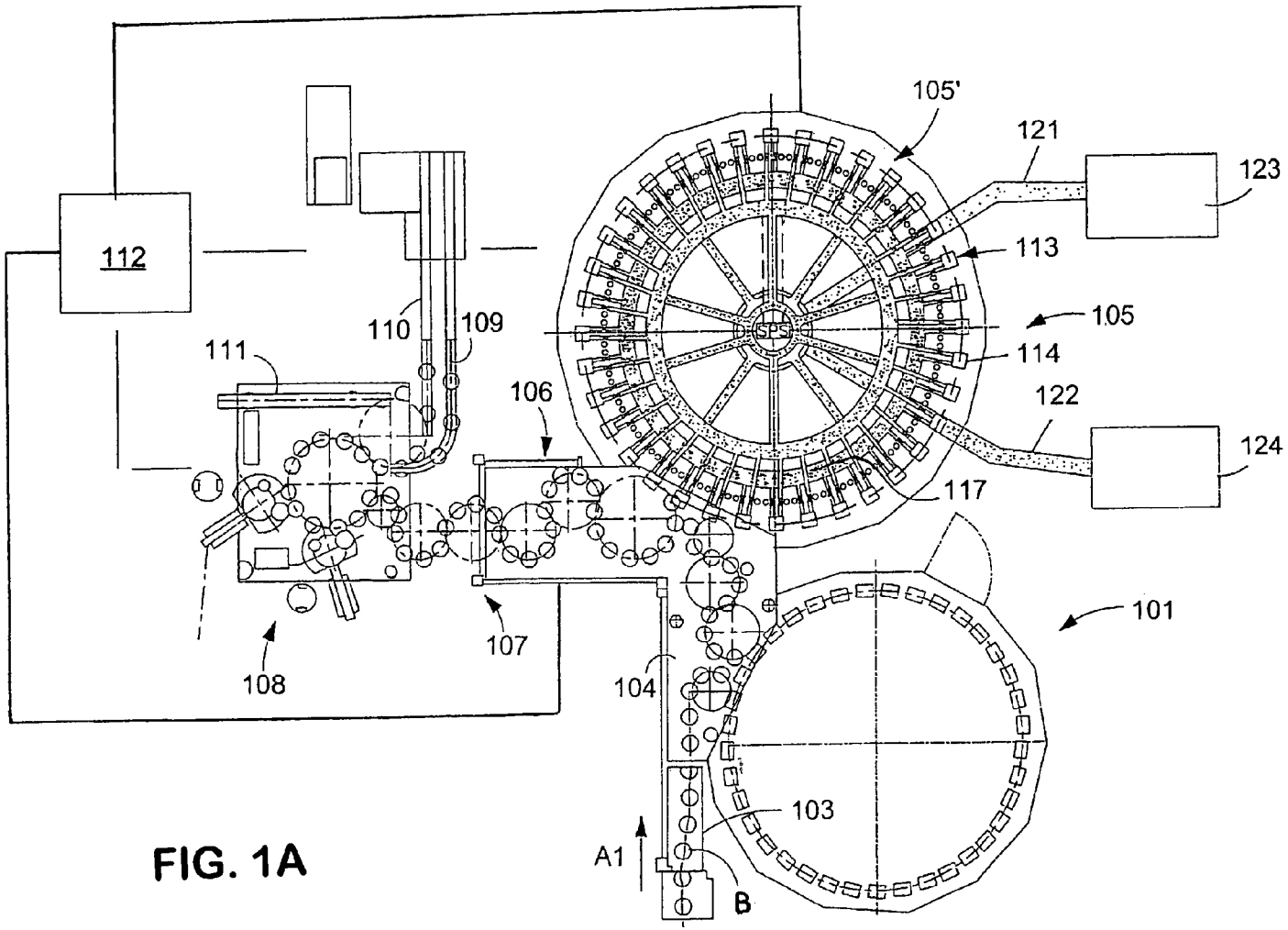
FIG. 1A shows a container filling plant, such as a beverage bottle filling plant, according to at least one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

As shown in FIG. 1, novel configurations of setup tables for container handling machines make it possible to connect the components or machines required for beverage bottling, such as, for example, transfer star wheels or rinsers, filling machines and capping machines, with one another in a simple and economical manner. For this purpose, the setup tables of the prior art are replaced by rod-shaped connecting elements, whereby said connecting elements connect the handling machines with one another and, if necessary, include additional elements such as transfer, inlet and outlet star wheels, feed worms and guides, and serve as fastenings for the latter elements.

Figure 2:
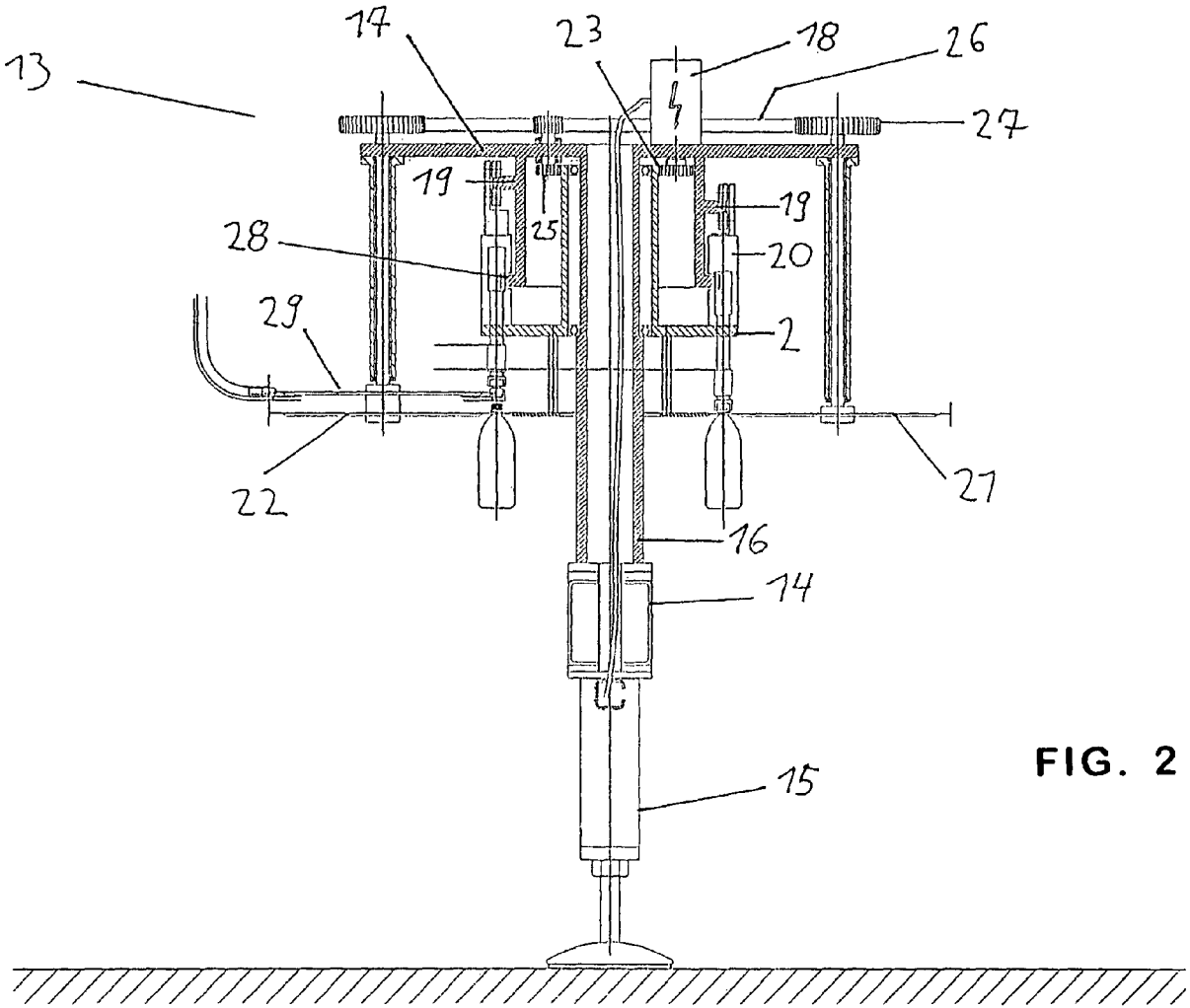
FIG. 2 is a simplified view in partial section of one embodiment in the form of a screw-capping machine.

FIG. 2 shows, in the form of one exemplary embodiment of a capping machine 13 of the present application, a screw-capper that employs a rotary construction.

This capping machine has, as its essential components, a non-rotating center pillar 16, and is connected mechanically and/or by means of a power transmission with the surrounding space only by means of said central pillar 16.

The central pillar 16 in the illustrated exemplary embodiment is located on a connecting element 14 which creates a connection to a filling machine, for example. The connecting element 14 is in turn supported on the floor 33 of the building by means of a support foot 15.

However, an embodiment in which the central pillar 16 is fastened directly or indirectly to the floor of the building or to a base frame or housing is still within the framework of the invention.

Starting from the lower end of the central pillar 16, the pillar 16 first forms the receptacles or fastening points for the bearings 30 of the rotating carousel 2 of the capping machine 13.

On its upper end, the central pillar 16 makes a transition into a head plate 17.

One function of this head plate is first to form the receptacles or fastening points for the following components that do not rotate with the carousel 2 of the capping machine: the rotation or drive motor 18 of the carousel, the lifting cam 19 for the up and down movement of the screwing elements 20, drive gearing 28 for the generation of the rotational movement of the screwing elements 20, the inlet star wheel 21 and the outlet star wheel 22.

During the operation of the capping machine claimed by the invention, the drive motor 18, by means of a pinion 31 located on its output shaft, drives an external-tooth gear 23 attached to the carousel 2 and thereby imparts the desired rotational movement to the carousel 2.

In the preferred exemplary embodiment of the invention illustrated in the drawings, the drive motor 18 is fastened to the head plate 17, although there are other positions in which it can conceivably be installed, such as the central pillar 16, for example.

The drive motor 18 is preferably a servo-motor or a synchronous motor. In the context of this application, these terms are used to mean any type of drive motor that can operated in a controlled manner, whereby the angle of rotation, the direction of rotation, the angular velocity and torque of the motor can be specified individually or in any desired combination by a control device, such as a control computer, for example, which uses sensors to determine the current values, compares said values with the setpoints and automatically takes countermeasures to correct for any differences.

The use of motors of this type makes it possible for the invention to eliminate the complex and expensive mechanical coupling of the rotational movements of filling and capping machines.

This invention also teaches that the inlet and outlet start wheels 21, 22 which are fastened only to the top plate 17 can be driven directly by the rotational movement of the carousel 2. For this purpose, on the top plate 17 there is first a pinion 25 which is driven by the externally-toothed gear wheel 23 of the rotating carousel 2.

The rotational motion of the pinion 25 is transmitted by suitable elements, such as toothed belts 26 and toothed belt pullets 27, for example, to the star wheels 21 and 22.

In an additional configuration of the invention, the star wheels 21, 22 are driven by means of one or two servomotors, whereby the servomotor(s) can also be located on the top plate.

On screw-top cappers, it is necessary to feed the screw tops to the screwing elements 20. In one development of the invention, a transfer star wheel 29 is located on the shaft of an inlet star wheel 21 or outlet star wheel 22 to transfer the screw caps. The transfer star wheel 29 extracts the screw tops from a feed arrangement 32 (see FIG. 2A) in a supply position and transfers them into the area of action of the screwing elements 20, where the screwing elements 20 are lowered onto the screw tops and clamp onto the screw tops.

This method results in a further reduction of the number of components and therefore in further cost reductions.

Figure 3:
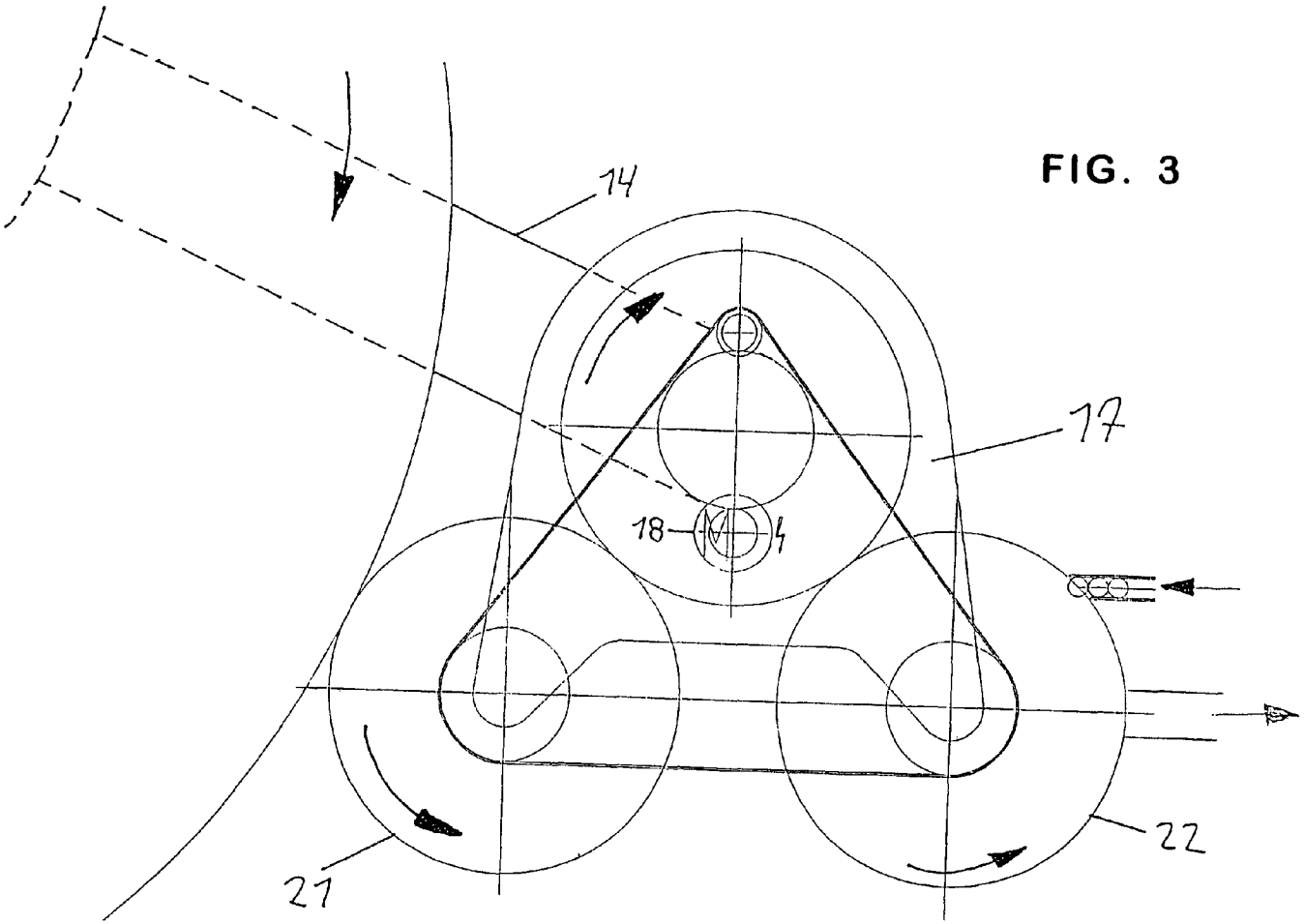
FIG. 3 is an overhead view showing a filling machine with a capper.

It should be noted that the drive motor 18 and the externally-toothed gear wheel 23 are located to the right side of the pillar 16 in FIG. 2, and the pinion 25 is located to the left side of the pillar 16. In this particular embodiment, the drive motor is located closer to the central vertical axis of the inlet star wheel 21 than the central vertical axis of the outlet star wheel 22. Similarly, the pinion 25 is located closer to the central vertical axis of the outlet star wheel 22 than the central vertical axis of the inlet star wheel 21. However, in another possible embodiment, the drive motor 18 is located essentially equidistant from the central vertical axes of the inlet star wheel 21 and the outlet star wheel 22, such as is shown in FIG. 3, which shows an overhead view showing a filling machine with a capper. The pinion 25 is also located essentially equidistant from the central vertical axes of the inlet star wheel 21 and the outlet star wheel 22.

Figure 2A:
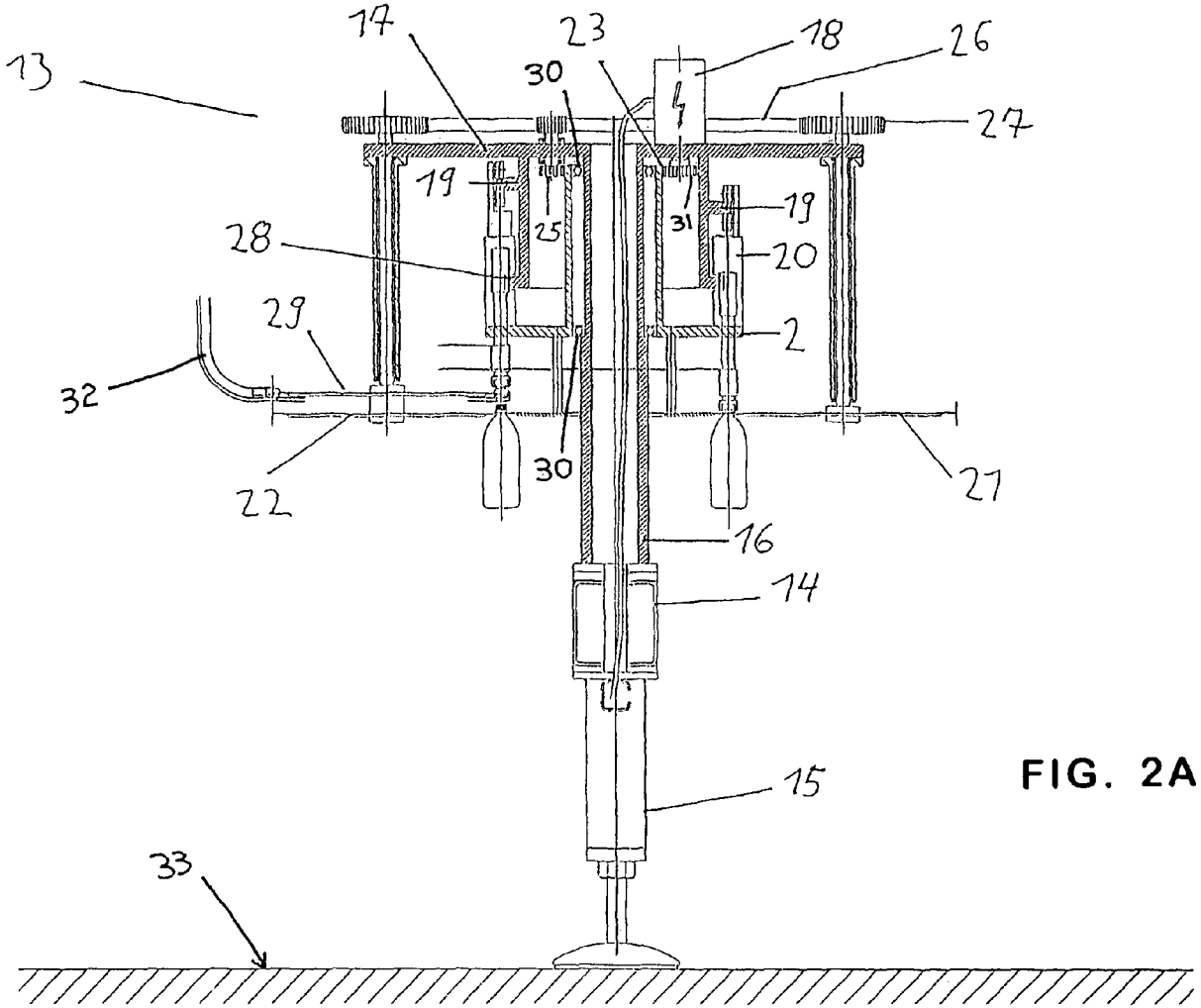
FIG. 2A is similar to the view shown in FIG. 2 with additional features.

It should be understood that in other possible embodiments the drive motor 18 and the pinion 25 may be located at different positions on the top plate 17 and around the central pillar 16 than what is shown in FIGS. 2, 2A, and 3. The pinion 25, however, must be positioned such that the toothed belts 26 neither contact nor are blocked by the drive motor 18. In this manner, a variety of different positions of the pinion 25 and the drive motor 18 are possible within the scope of the application.

This invention also makes it possible to keep the stationary and non-rotating central pillar 16 of a capping machine which is mechanically connected with the surrounding space by said central pillar 16, free of elements for the mechanical transmission of force, such as, for example, drive shafts, as a result of which, if necessary, lines for kinetic energy and/or control information that is present in electrical or optical form and/or fluids, e.g. hydraulic fluid or compressed air, can be conducted through the central pillar 16. The category of control information present in optical form includes, for example, information transmitted through optical fibers to control the capping machine, whereby the optical transmission is characterized by a particular insensitivity to interference and high speeds.

Figure 4:
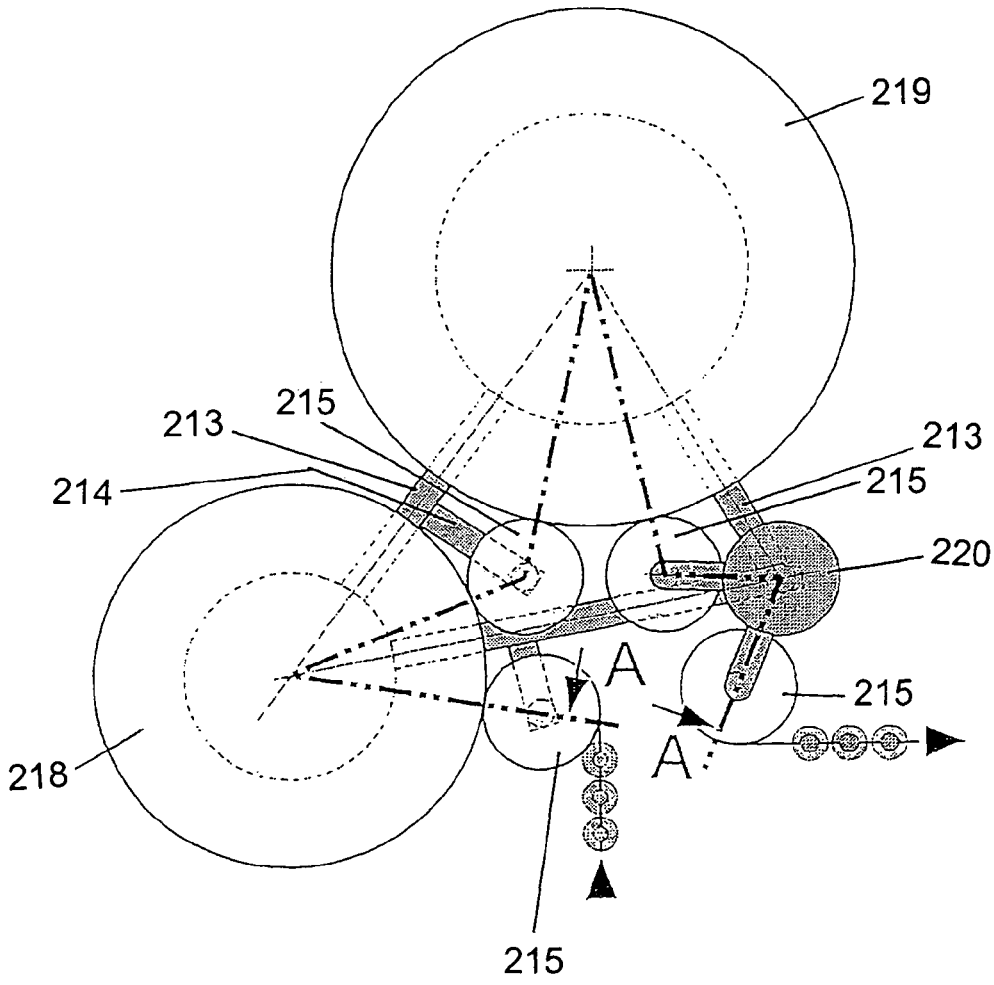
FIG. 4 shows, in a simplified plan view from overhead, an arrangement of rinser, filler and capping machine with inlet and outlet star wheels, equipped with a receiving table.

As shown in FIG. 4, a receiving table as described in the present application comprises essentially bar-shaped or rod-shaped connecting elements 213 which on one hand connect the individual container handling machines, in this case the rinser 218, filler 219 and capper 220, with one another and on the other hand serve as mountings for the corresponding transport star wheels 215, i.e. the inlet, outlet and transfer star wheels, and/or offer fastening fixtures for these star wheels.

In the exemplary embodiment illustrated, the container handling machines used are joined together by the associated connecting elements 213 in the form of a triangle, which is particularly advantageous in terms of the stability that can be achieved.

The connecting elements are advantageously fastened between or to the foundation rings 221 of the container handling machines. The receptacles 214 for the transport star wheels 215 and/or the transport star wheels 215 themselves are fastened to said connecting elements 213 in a suitable manner.

The connecting elements 213 can be tubes, for example, which have a round, triangular, rectangular or polygon shape, although the cross section of the connecting elements can also be any desired shape, e.g. profiles formed by compression across the edges, die casting, extrusion, rolling or similar processes.

The scope of protection of this application also includes those configurations which, in contrast to the exemplary embodiment illustrated in FIG. 4, use connecting elements 213 that have a shape that is not essentially straight, e.g. connecting elements 213 that are curved or bent at an angle.

Figure 5:
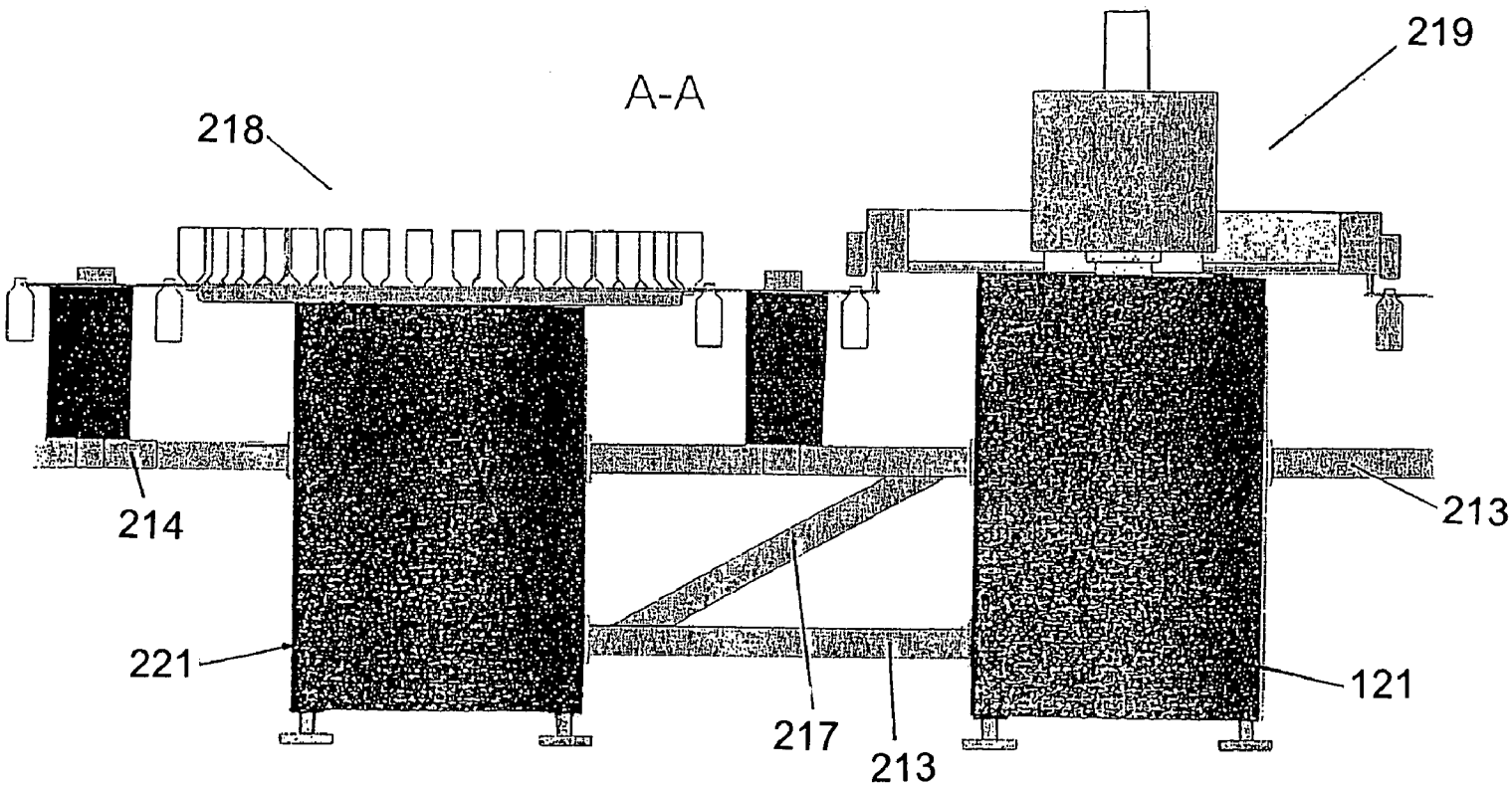
FIG. 5 is a simplified side view of one exemplary embodiment with a rinser and a filling machine.
Figure 6:
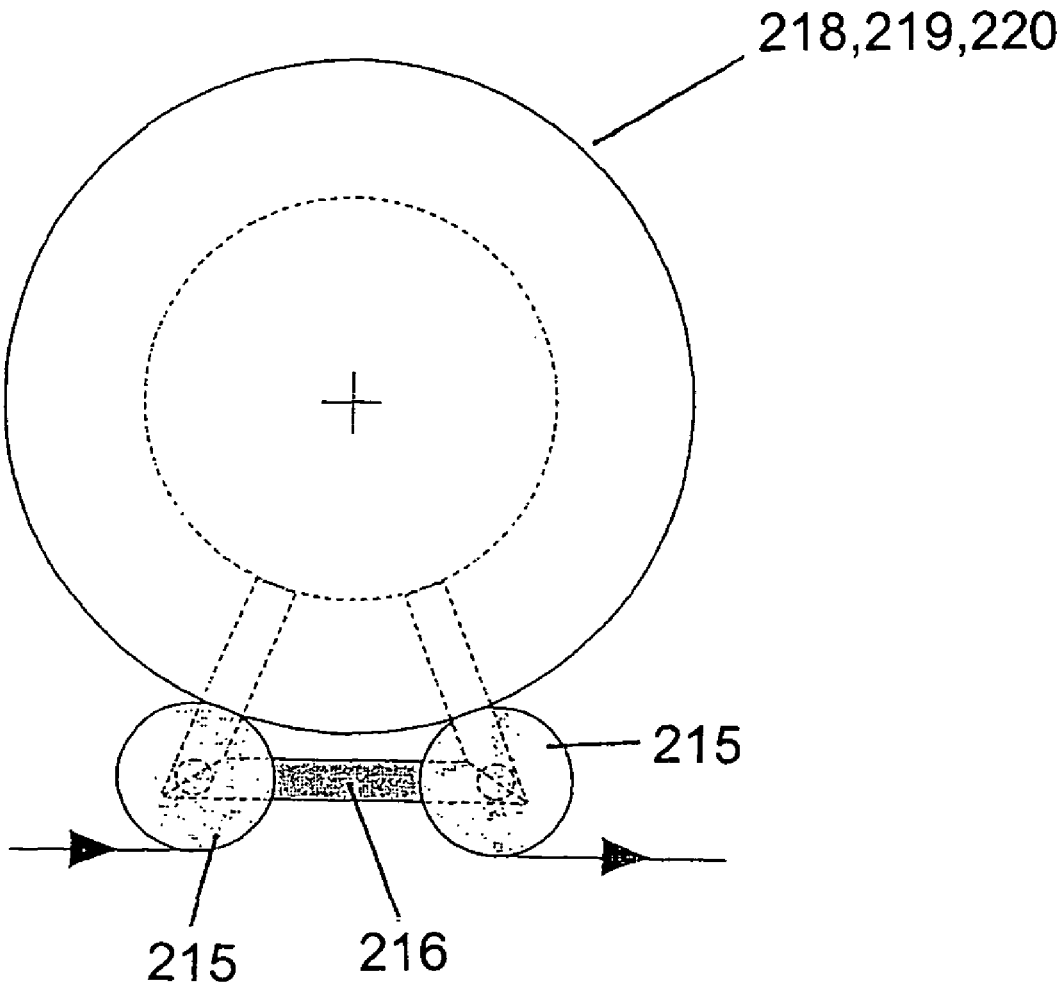
FIG. 6 shows a configuration with a container handling machine and the corresponding transport star wheels.

In a further realization, the present application teaches that not only combinations of container handling machines can be connected in the manner illustrated in FIGS. 4 and 5. The present application also teaches that individual container handling machines, such as a filling machine 219, for example, can be connected in the manner taught by the present application with the necessary transport star wheels 215 (FIG. 6).

The present application teaches first that the connecting elements 213 are fastened to the foundation ring 221 of the container handling machine so that the connecting elements extend outward essentially radially from the midpoint of the container handling machine. The receptacles 214 for the transport star wheels 215 are located on these connecting elements 213.

For the case in which there is a requirement for increased stability, the present application also teaches that the connecting elements 213 that extend radially outward can be reinforced by an additional bracing element 16 that is located between them.

The scope of the present application also extends to configurations in which the connecting elements 213 are not fastened to the foundation rings 221 in the manner described above. In such configurations, the connecting elements 213 can, for example, be connected to the foundation rings 221 tangentially or at any arbitrary angle.

As illustrated in FIG. 5, the present application also teaches that the connecting elements 213 are not only located in one single vertical level, but that they can also be located in a plurality of vertical levels, and that they can extend over a plurality of vertical levels. In an additional configuration, the present application teaches that the connecting elements 213 located on different vertical levels can be connected by vertical braces 217, which results in additional advantages in terms of stability.

For an additional and altogether advantageous configuration, the present application teaches that the shape of the cross section surface of the connecting elements 213 can be realized so that the connecting elements do not have any external surfaces on which fluids or dirt can collect and/or be deposited. This features is achieved essentially because the upper external surfaces of the connecting elements 213 are not realized in the horizontal orientation but in an angled or inclined orientation and/or in the form of circular or convexly curved surfaces.

The present application further teaches that on the ends of the connecting elements 213, on at least one end there are elements to adjust and/or orient the connecting elements 213 and/or the container handling machines.

The scope of protection of the present application also includes the case in which, instead of the essentially bar-shaped or rod-shaped connecting elements 213, flat connecting elements, e.g. connecting elements made of sheet metal or a similar material, are used.

Certain types of container handling machines require inlet star wheels or feed worms, the purpose of which is to arrange the containers that are all jammed up at the intervals required by the machine.

Certain types of container handling machines also require guide elements to safely and smoothly guide the containers through the container handling machines, whereby the guides in question can be internal or external guides, for example. The containers can also be fed to and removed from certain container handling machines using conveyor belts.

In the context of the present application, at least these elements, i.e. the feed worms, guide elements and conveyor belts, can also be fastened directly or indirectly to the connecting elements 213. Thus the above description, in the sections that relate to transport star wheels 215, must be understood as meaning that the location and arrangement of these container transport elements on the connecting elements 213 is also disclosed, if and to the extent that said additional container transport elements are appropriate in this location.

In the context of an additional configuration of the embodiments, the present application teaches that there are coverings or a housing to protect against noise, accidents or contact, of the type that are frequently provided on container handling machines, are located or fastened directly or indirectly on the connecting elements 213. This feature has additional advantages in terms of cleaning and reduced costs.

The configurations taught in the context of the present application have significant advantages. Thus, for example, the cleaning and/or disinfection operations are simpler and cheaper on account of the reduced size of the surface and the improved configuration. The use of the connecting elements 213 taught by the present application significantly reduces the manufacturing costs and the amount of time required for the assembly and installation of the container handling machines.

According to another possible embodiment, the connecting elements 213 could be oblong connecting elements comprising a length, a width, and a thickness. In this possible embodiment, the length could be substantially greater than either of the width and the thickness. For example, the length could be at least as long as either of the width and the thickness. The oblong connecting elements could possibly span between two machines in a beverage bottling plant, such as the filling machine and the capping machine. In addition, the oblong connecting elements could possibly span between three machines in a beverage bottling plant, such as the filling machine, the capping machine, and the labeling machine. It should be noted that there are any number of possible configurations of the oblong connecting elements and the receiving tables in a beverage bottling plant, and the above descriptions are not meant to limit the present applications in any way.

In other possible embodiments, the receiving tables could comprise one oblong connecting member on one vertical level with no vertical brace. In addition, in other possible embodiments, the receiving tables could comprise two oblong connecting members on two different vertical levels with a vertical brace. It should be noted that any number of oblong connecting members are possible in different configurations of the receiving table, and the above descriptions are not meant to limit the present application in any way.

The invention relates to a capping machine with a rotary construction for the capping of containers such as, for example, bottles or similar containers with screw tops or crown corks with a rotating carousel on which a plurality of container capping positions, each equipped with a capping element, are formed, whereby the invention teaches that the capping machine is connected mechanically and/or for the transmission of force only by means of a non-rotating central pillar with the space surrounding the capping machine.

One feature or aspect of an embodiment is believed at the time of the filing of this patent application to possibly reside broadly in a capping machine employing a rotary construction for the capping of containers such as, for example, bottles or similar containers with screw tops or crown corks with a rotating carousel on which a plurality of container capping positions, each equipped with a capping element, are formed, characterized by the fact that the capping machine is connected mechanically and/or for the transmission of force only by means of a non-rotating central pillar with the space surrounding the capping machine.

Another feature or aspect of an embodiment is believed at the time of the filing of this patent application to possibly reside broadly in a capping machine, wherein the stationary central pillar contains only lines for kinetic energy and/or control information present in electrical or optical form and/or fluids.

A further feature or aspect of an embodiment is believed at the time of the filing of this patent application to possibly reside broadly in a capping machine, wherein the capping machine includes an inlet star wheel and/or an outlet star wheel.

Yet another feature or aspect of an embodiment is believed at the time of the filing of this patent application to possibly reside broadly in a capping machine, wherein the inlet star wheel and/or the outlet star wheel are fastened exclusively to the capping machine.

Still another feature or aspect of an embodiment is believed at the time of the filing of this patent application to possibly reside broadly in a capping machine, wherein the inlet star wheel and/or the outlet star wheel are driven by the drive motor of the capping machine.

Another feature or aspect of an embodiment is believed at the time of the filing of this patent application to possibly reside broadly in a capping machine, wherein the inlet star wheel and/or the outlet star wheel are driven by means of an arrangement of toothed belts and toothed belt pulleys.

Yet another feature or aspect of an embodiment is believed at the time of the filing of this patent application to possibly reside broadly in a capping machine, wherein the inlet star wheel and or the outlet star wheel are driven by at least one separate servomotor.

Still another feature or aspect of an embodiment is believed at the time of the filing of this patent application to possibly reside broadly in a capping machine, wherein the capping machine includes a transfer star wheel for the transfer of the screw tops.

A further feature or aspect of an embodiment is believed at the time of the filing of this patent application to possibly reside broadly in a capping machine, wherein the transfer star wheel is fastened with an inlet or outlet star wheel on a common shaft and is driven in rotation by said shaft.

Another feature or aspect of an embodiment is believed at the time of the filing of this patent application to possibly reside broadly in a capping machine, wherein the drive motor of the capping machine is fastened exclusively to said capping machine.

Yet another feature or aspect of an embodiment is believed at the time of the filing of this patent application to possibly reside broadly in a capping machine, wherein the drive motor is a servomotor, stepper motor or synchronous motor.

The components disclosed in the various publications, disclosed or incorporated by reference herein, may possibly be used in possible embodiments of the present invention, as well as equivalents thereof.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The corresponding foreign patent publication applications, namely, Federal Republic of Germany Patent Application No. 10 2004 050 397.4, filed on Oct. 15, 2004, having inventor Herbert BERNHARD, and DE-OS 10 2004 050 397.4 and DE-PS 10 2004 050 397.4, and Federal Republic of Germany Patent Application No. 10 2004 049 330.8, filed on Oct. 9, 2004, having inventor Herbert Bernhard, and DE-OS 10 2004 049 330.8 and DE-PS 10 2004 049 330.8, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

U.S. application Ser. No. 11/245,948, entitled "A Beverage Bottling Plant for Filling Bottles with a Liquid Beverage Filling Material Having a Receiving Table for the Container Handling Machines Therein", filed Oct. 7, 2005, having inventor Herbert Bernhard, is hereby incorporated by reference as if set forth in its entirety herein.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

Some examples of bottling and container handling systems and components thereof which may possibly be utilized or adapted for use in at least one possible embodiment, may possibly be found in the following U.S. patent applications: Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004, Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A container filling plant for filling containers with liquid, said container filling plant comprising:

a rotary container filling machine being configured and disposed to fill containers with liquid;

a first conveyor arrangement being configured and disposed to convey containers to be filled to said container filling machine;

said container filling machine comprising:

a rotatable carousel;

a vertical machine column;

said rotatable carousel being connected to said vertical machine column to permit rotation of said rotatable carousel about said vertical machine column;

a plurality of container filling elements for filling containers with liquid being disposed on the periphery of said rotatable carousel;

each of said plurality of container filling elements comprising a container carrier being configured and disposed to receive and hold containers to be filled;

each of said plurality of container filling elements being configured and disposed to dispense liquid into containers to be filled;

at least one liquid reservoir being configured to hold a supply of liquid; and at least one supply line being configured and disposed to connect said at least one liquid reservoir to said container filling machine to supply liquid to said container filling machine;

a first star wheel structure being configured and disposed to move containers into said container filling machine;

a rotary container closing machine being configured and disposed to close tops of filled containers;

a second star wheel structure being configured and disposed to move containers out of said container filling machine and into said container closing machine;

said container closing machine comprising:

a rotatable carousel;

a non-rotating central pillar;

said rotatable carousel being connected to said central pillar to permit rotation of said rotatable carousel about said central pillar;

said central pillar having a diameter being substantially smaller than an outer diameter of said rotatable carousel;

a plurality of closing devices being disposed on the periphery of said rotatable carousel;

each of said plurality of closing devices being configured and disposed to place closures on filled containers, said closures comprising at least one of: screw tops and crown corks; and each of said plurality of closing devices comprising a container carrier being configured and disposed to receive and hold filled containers;

a third star wheel structure being configured and disposed to move filled, closed containers out of said container closing machine; and the weight of said closing machine being supported essentially only by said non-rotating central pillar.

2. The container filling plant according to claim 1, wherein:

said container filling plant comprises a support frame structure;

said support frame structure is configured and disposed to support at least said filling machine and said closing machine thereon, and to absorb torque produced by at least said filling machine and said closing machine; and said closing machine is configured to transmit torque to said support frame structure essentially only through said non-rotating central pillar.

3. The container filling plant according to claim 2, wherein:

said central pillar comprises a housing for housing essentially only at least one of: lines for power, lines for control information present in electrical or optical form, and lines for fluids; and at least one of: said second star wheel structure and said third star wheel structure is mounted on and connected to solely said closing machine.

4. The container filling plant according to claim 3, wherein one of (A) and (B):

(A) said closing machine comprises a drive motor configured to provide a drive force to rotate said rotatable carousel; and at least one of: said second star wheel structure and said third star wheel structure is driven by said drive motor, and is connected to said drive motor by an arrangement comprising toothed belts and toothed belt pulleys; and (B) said closing machine comprises a drive motor configured to provide a drive force to rotate said rotatable carousel; and at least one of: said second star wheel structure and said third star wheel structure is driven by at least one separate servomotor.

5. The container filling plant according to claim 4, wherein:

said closing machine comprises a transfer star wheel for the transfer of said closures;

said transfer star wheel is fastened to one of: said second star wheel structure and said third star wheel structure on a common shaft and is driven in rotation by said shaft;

said drive motor is mounted solely on the frame of said closing machine; and said drive motor is one of: a servomotor, a stepper motor or a synchronous motor.

6. The container filling plant according to claim 5, wherein:

said support frame comprises at least one oblong connecting element configured and disposed to span between said filling machine and said closing machine, and to connect said filling machine and said closing machine;

said at least one oblong connecting element has a length, a width, and a thickness, wherein said length is substantially greater than either of said width and said thickness;

said support frame is configured to minimize collection of dirt, dust, debris, or liquid beverage spillage, and is configured to minimize size to minimize the amount of material of which said support frame is made;

said support frame is configured to be sufficiently rigid to support or hold at least one of: said first starwheel structure, said second starwheel structure, and said third starwheel structure thereon;

the external configuration of the cross section surface of said at least one oblong connecting element has no horizontal surfaces; and said at least one oblong connecting element has external surfaces that are angled and/or inclined and/or circular and/or convexly curved.

7. A container filling plant for filling containers with liquid, said container filling plant comprising:

a rotary container filling machine being configured and disposed to fill containers with liquid;

a first moving arrangement being configured and disposed to move containers to be filled into said container filling machine;

said container filling machine comprising:

a rotatable carousel;

a vertical machine column;

said rotatable carousel being connected to said vertical machine column to permit rotation of said rotatable carousel about said vertical machine column;

a plurality of container filling elements for filling containers with liquid being disposed on the periphery of said rotatable carousel;

each of said plurality of container filling elements comprising a container carrier being configured and disposed to receive and hold containers to be filled; and each of said plurality of container filling elements being configured and disposed to dispense liquid into containers to be filled;

a rotary container closing machine being configured and disposed to close tops of filled containers;

a second moving arrangement being configured and disposed to move containers out of said container filling machine and into said container closing machine;

said container closing machine comprising:

a rotatable carousel;

a non-rotating central pillar;

said rotatable carousel being connected to said central pillar to permit rotation of said rotatable carousel about said central pillar;

said central pillar having a diameter being substantially smaller than an outer diameter of said rotatable carousel;

a plurality of closing devices being disposed on the periphery of said rotatable carousel;

each of said plurality of closing devices being configured and disposed to place closures on filled containers, said closures comprising at least one of: screw tops and crown corks; and each of said plurality of closing devices comprising a container carrier being configured and disposed to receive and hold filled containers;

a third moving arrangement being configured and disposed to move filled, closed containers out of said container closing machine; and the weight of said closing machine being supported essentially only by said non-rotating central pillar.

8. The container filling plant according to claim 7, wherein:

said container filling plant comprises a support frame structure;

said support frame structure is configured and disposed to support at least said filling machine and said closing machine thereon, and to absorb torque produced by at least said filling machine and said closing machine; and said closing machine is configured to transmit torque to said support frame structure essentially only through said non-rotating central pillar.

9. The container filling plant according to claim 8, wherein:

said central pillar comprises a housing for housing essentially only at least one of: lines for power, lines for control information present in electrical or optical form, and lines for fluids;

said second moving arrangement comprises a star wheel structure;

said third moving arrangement comprises a star wheel structure; and at least one of: said star wheel structure of said second moving arrangement and said star wheel structure said third moving arrangement is mounted on and connected to solely said closing machine.

10. The container filling plant according to claim 9, wherein one of (A) and (B):

(A) said closing machine comprises a drive motor configured to provide a drive force to rotate said rotatable carousel; and at least one of: said star wheel structure of said second moving arrangement and said star wheel structure of said third moving arrangement is driven by said drive motor, and is connected to said drive motor by an arrangement comprising toothed belts and toothed belt pulleys; and (B) said closing machine comprises a drive motor configured to provide a drive force to rotate said rotatable carousel; and at least one of: said star wheel structure of said second moving arrangement and said star wheel structure of said third moving arrangement is driven by at least one separate servomotor.

11. The container filling plant according to claim 10, wherein:

said closing machine comprises a transfer star wheel for the transfer of said closures;

said transfer star wheel is fastened to one of: said star wheel structure of said second moving arrangement and said star wheel structure of said third moving arrangement on a common shaft and is driven in rotation by said shaft;

said drive motor is mounted solely on the frame of said closing machine; and said drive motor is one of: a servomotor, a stepper motor or a synchronous motor.

12. The container filling plant according to claim 11, wherein:

said support frame comprises at least one oblong connecting element configured and disposed to span between said filling machine and said closing machine, and to connect said filling machine and said closing machine;

said at least one oblong connecting element has a length, a width, and a thickness, wherein said length is substantially greater than either of said width and said thickness;

said support frame is configured to minimize collection of dirt, dust, debris, or liquid beverage spillage, and is configured to minimize size to minimize the amount of material of which said support frame is made;

said support frame is configured to be sufficiently rigid to support or hold at least one of: said first starwheel structure, said second starwheel structure, and said third starwheel structure thereon;

the external configuration of the cross section surface of said at least one oblong connecting element has no horizontal surfaces; and said at least one oblong connecting element has external surfaces that are angled and/or inclined and/or circular and/or convexly curved.

13. A container filling plant for filling containers with liquid, said container filling plant comprising:

a rotary container filling machine being configured and disposed to fill containers with liquid;

a first moving arrangement being configured and disposed to move containers to be filled into said container filling machine;

said container filling machine comprising:

a rotatable carousel;

a vertical machine column;

said rotatable carousel being connected to said vertical machine column to permit rotation of said rotatable carousel about said vertical machine column;

a plurality of container filling elements for filling containers with liquid being disposed on the periphery of said rotatable carousel;

each of said plurality of container filling elements comprising a container carrier being configured and disposed to receive and hold containers to be filled; and each of said plurality of container filling elements being configured and disposed to dispense liquid into containers to be filled;

a rotary container closing machine being configured and disposed to close tops of filled containers;

a second moving arrangement being configured and disposed to move containers out of said container filling machine and into said container closing machine;

said container closing machine comprising:

a rotatable carousel;

a non-rotating central pillar;

said rotatable carousel being connected to said central pillar to permit rotation of said rotatable carousel about said central pillar;

said central pillar having a diameter being substantially smaller than an outer diameter of said rotatable carousel;

a plurality of closing devices being disposed on the periphery of said rotatable carousel;

each of said plurality of closing devices being configured and disposed to place closures on filled containers, said closures comprising at least one of: screw tops and crown corks; and each of said plurality of closing devices comprising a container carrier being configured and disposed to receive and hold filled containers;

a third moving arrangement being configured and disposed to move filled, closed containers out of said container closing machine; and the weight of said closing machine being supported by said non-rotating central pillar.

14. The container filling plant according to claim 13, wherein:

said container filling plant comprises a support frame structure;

said support frame structure is configured and disposed to support at least said filling machine and said closing machine thereon, and to absorb torque produced by at least said filling machine and said closing machine; and said closing machine is configured to transmit torque to said support frame structure through said non-rotating central pillar.

15. The container filling plant according to claim 14, wherein said central pillar comprises a housing for housing at least one of: lines for power, lines for control information present in electrical or optical form, and lines for fluids.

16. The container filling plant according to claim 15, wherein:

said second moving arrangement comprises a star wheel structure;

said third moving arrangement comprises a star wheel structure; and at least one of: said star wheel structure of said second moving arrangement and said star wheel structure said third moving arrangement is mounted on and connected to said closing machine.

17. The container filling plant according to claim 16, wherein one of (A) and (B):

(A) said closing machine comprises a drive motor configured to provide a drive force to rotate said rotatable carousel; and at least one of: said star wheel structure of said second moving arrangement and said star wheel structure of said third moving arrangement is driven by said drive motor, and is connected to said drive motor by an arrangement comprising toothed belts and toothed belt pulleys; and (B) said closing machine comprises a drive motor configured to provide a drive force to rotate said rotatable carousel; and at least one of: said star wheel structure of said second moving arrangement and said star wheel structure of said third moving arrangement is driven by at least one separate servomotor.

18. The container filling plant according to claim 17, wherein:

said closing machine comprises a transfer star wheel for the transfer of said closures;

said transfer star wheel is fastened to one of: said star wheel structure of said second moving arrangement and said star wheel structure of said third moving arrangement on a common shaft and is driven in rotation by said shaft;

said drive motor is mounted on the frame of said closing machine; and said drive motor is one of: a servomotor, a stepper motor or a synchronous motor.

19. The container filling plant according to claim 18, wherein:

said support frame comprises at least one oblong connecting element configured and disposed to span between said filling machine and said closing machine, and to connect said filling machine and said closing machine;

said at least one oblong connecting element has a length, a width, and a thickness, wherein said length is substantially greater than either of said width and said thickness;

said support frame is configured to minimize collection of dirt, dust, debris, or liquid beverage spillage, and is configured to minimize size to minimize the amount of material of which said support frame is made;

said support frame is configured to be sufficiently rigid to support or hold at least one of: said first starwheel structure, said second starwheel structure, and said third starwheel structure thereon;

the external configuration of the cross section surface of said at least one oblong connecting element has no horizontal surfaces; and said at least one oblong connecting element has external surfaces that are angled and/or inclined and/or circular and/or convexly curved.

20. The container filling plant according to claim 14, wherein:

said support frame comprises at least one oblong connecting element configured and disposed to span between said filling machine and said closing machine, and to connect said filling machine and said closing machine;

said at least one oblong connecting element has a length, a width, and a thickness, wherein said length is substantially greater than either of said width and said thickness;

said support frame is configured to minimize collection of dirt, dust, debris, or liquid beverage spillage, and is configured to minimize size to minimize the amount of material of which said support frame is made;

said support frame is configured to be sufficiently rigid to support or hold at least one of: said first starwheel structure, said second starwheel structure, and said third starwheel structure thereon;

the external configuration of the cross section surface of said at least one oblong connecting element has no horizontal surfaces; and said at least one oblong connecting element has external surfaces that are angled and/or inclined and/or circular and/or convexly curved.

* * * * *